US005749523A

United States Patent [19]

Drechsel

[11] Patent Number: 5,749,523

[45] Date of Patent: May 12, 1998

[54] JET ACTUATOR PARTICULARLY FOR PULSE SPRINKLERS

[76] Inventor: Arno Drechsel, Via Castel Mareccio 4, 39100 - Bolzano, Italy

[21] Appl. No.: 732,280

[22] PCT Filed: Jan. 26, 1995

[86] PCT No.: PCT/EP95/00278

§ 371 Date: Jan. 29, 1997

§ 102(e) Date: Jan. 29, 1997

[87] PCT Pub. No.: WO95/31288

PCT Pub. Date: Nov. 23, 1995

[30] Foreign Application Priority Data

May 12, 1994 [IT] Italy ..... VI94A0069

[51] Int. Cl.[6] ..... B05B 3/14

[52] U.S. Cl. ..... 239/233

[58] Field of Search ..... 239/222.17, 233, 239/230, 232

[56] References Cited

U.S. PATENT DOCUMENTS

| | | | |
|---|---|---|---|
| 3,580,507 | 5/1971 | Beamer | 239/233 |
| 3,744,720 | 7/1973 | Meyer | 239/233 X |
| 4,109,866 | 8/1978 | Brandl | 239/233 |
| 4,669,663 | 6/1987 | Meyer | 239/233 X |
| 4,858,829 | 8/1989 | Drechsel | 239/233 X |

FOREIGN PATENT DOCUMENTS

| | | | |
|---|---|---|---|
| 1535468 | 1/1990 | U.S.S.R. | 239/233 |

*Primary Examiner*—Kevin Weldon

*Attorney, Agent, or Firm*—R. Neil Sudol; Henry D. Coleman

[57] ABSTRACT

A jet actuator, particularly for actuating hydraulic apparatus such as rotating pulse sprinklers, comprises a nozzle for generating a free jet of water directed along a first longitudinal axis, the nozzle being located at the free end of a spout, the spout being coupled to a line of pressurized water by means of a rotatable joint having a second rotation axis that is transverse to the first longitudinal axis. A deflector is provided which can freely oscillate in a transverse direction between a first end position wherein the deflector lies completely outside the jet and a second end position wherein the deflector is immersed to the maximum extent in the jet so as to draw part of its energy. A support is provided for oscillably mounting the deflector on the spout to transfer the energy drawn from the jet to the spout to promote a stepwise movement thereof about the second rotation axis. The deflector has at least one main surface having a curved and convex shape suitable to laterally enter the jet while remaining substantially aligned with the jet, so as to generate a negative pressure force tending to move the deflector towards the interior of the jet upon initial oscillation and during steady-state oscillatory operation. The deflector has a secondary surface that is substantially flat and forms with respect to the curved main surface a solid angle that is relatively large so as to generate a reaction force with a component which is opposite to the negative pressure force produced on the curved main surface and tending to expel the deflector away from the jet thus starting and maintaining the steady-state operation.

23 Claims, 5 Drawing Sheets

JET ACTUATOR PARTICULARLY FOR PULSE SPRINKLERS

BACKGROUND OF THE INVENTION

The present invention relates to jet actuator particularly for actuating rotary pulse sprinklers.

The device according to the invention can also be advantageously applied to the actuation of other hydraulic devices, such as for example valves, gate valves, systems for signalling and/or controlling the level of water basins or streams, located in regions that are not connected to electric lines, in developing countries or in countries that have limited energy resources.

It is known that rotary pulse sprinklers are generally constituted by a tubular body or spout which has, at one end, a joint for connection to a line for feeding pressurized water, and has, at the opposite end, a nozzle for producing a continuous jet that has a preset diameter and range. The joint is of the rotary type, with an approximately vertical rotation axis, and is anchored to a structure or to a trailer which rests on the ground or is rigidly coupled thereto.

In order to allow uniform water distribution over a circular region, through an adapted actuator the spout is rotated stepwise by using the energy of the jet that leaves the spout.

Conventional jet actuators essentially comprise a deflector means which is preset to draw part of the energy of the jet by interfering periodically with it. Generally, the deflection means is arranged at a certain distance from the nozzle and is mounted at the end of an arm which is mounted on the spout or on a connecting elbow, so that it can oscillate. The energy drawn by the deflector means is converted into a rotation torque which is applied to the spout so as to oppose the contrast action of a braking means which is associated with the rotating joint.

The deflector means has the additional function of breaking and periodically interrupting the jet, so as to obtain optimum radial distribution of the water.

Examples of pulse sprinklers with jet actuators are described in U.S. Pat. No. 3,744,720 and No. 4,231,522, in French patent no. 2,653,357, in German patent no. 1,151, 145, in Swiss patent no. 593,652, and in European patent no. 97 985.

A first drawback of these known actuators is their limited flexibility in use, since for a given deflector size and shape the optimum utilization range is relatively narrow with respect to variations in nozzle diameter and in operating pressures.

Known actuators in fact are generally preset to operate in an optimum manner with small-diameter jets and low operating pressures, or with large-diameter jets and high operating pressures.

Actuators suitable to operate with high pressures and large diameters are highly efficient in terms of fluid dynamics and generate pulse forces that are so intense as to require a proportional braking means both for the arm and for the joint.

Another drawback is the considerable complexity of known actuation devices, especially as regards the geometry of the deflection means.

Another drawback resides in the fact that the deflection means must be located in a specific and precise starting or idle position in order to start operating, otherwise the device does not start to operate.

OBJECTS OF THE INVENTION

From DE-A-2803644 is known a part-circle sprinkler head of the quick return type having all the features mentioned in the preamble of the enclosed claim 1, with a first deflector means mounted on an impulse arm and disposed within the path of the stream to impart an incremental stepwise rotation to the sprinkler body. The sprinkler has a second deflector means with a coanda-effect surface operable only when it is desired to effect the quick return rotation of the sprinkler head to its initial angular position. This arrangement may be dangerous for the personnel involved during the quick return rotation of the head and cannot ensure a reliable startup of the stepwise rotation.

The aim of the invention is to eliminate the drawbacks described above by providing a jet actuator that can be applied to rotating sprinklers and to other hydraulic devices and can operate in an optimum manner within a wide range of variation of jet diameters and operating pressures.

SUMMARY OF THE INVENTION

An object is to provide an actuator that generates actuation forces that vary by a relatively small extent when the above parameters vary, so as to avoid the use of a special or proportional braking means.

Another object is to provide an actuator applied to a rotating pulse sprinkler which allows to uniformly distribute the jet radially.

Another object of the invention is to provide a jet actuator that is reliable as regards startup conditions.

Another object of the invention is to provide a jet actuator which has an extremely simple and low-cost structure.

This aim and these objects are achieved by a jet actuator, particularly for the automatic actuation of hydraulic systems such as rotating pulse sprinklers, in accordance with the enclosed claim 1.

Preferably, the deflector-is located so that its curved main surface is approximately tangent to the jet when the deflector is skimming the jet.

Furthermore, the deflector is arranged so that during its immersion in the jet the axis thereof is incident to the main surface with a gradually increasing angle of incidence.

The main surface can be approximately cylindrical, with a relatively large and constant radius of curvature and with an axis that is substantially at right angles to the axis of the jet and has a right transverse cross-section that substantially forms a circular arc with a chord that forms, with respect to the axis of the jet, a relatively small average angle of incidence during immersion in the column.

Advantageously, the average angle of incidence has a critical value at which the fluid column of the jet breaks and is deflected away from the main surface, with a consequent sharp drop in the negative pressure force produced by fluid dynamics, producing a propulsive reaction force in the opposite direction.

Since the negative pressure forces produced by fluid dynamics vary very little when water pressure and jet diameter vary, the actuator allows a wide operating range with the same deflector and with a substantially constant effectiveness.

The negative pressure forces that act on the extrados of the convex main surface are sufficient to ensure the startup of the device and its steady-state operation even at very low flow-rates and pressures; the device is thus extremely reliable in any operating condition.

Since the actuator interacts with the flow in a predominantly tangent direction, it does not significantly reduce the range of the jet and allows to achieve satisfactory water distribution in a radial direction with respect to the rotation axis.

The actuator is constructively very simple and has a low manufacturing cost.

BRIEF DESCRIPTION OF THE DRAWINGS

Further characteristics and advantages of the invention will become apparent from the detailed description of some preferred but not exclusive embodiments of the jet actuator according to the invention, illustrated only by way of non-limitative example in the accompanying drawings, wherein.

DESCRIPTION OF THE PREFERRED EMBODIMENTS

Figure 1:
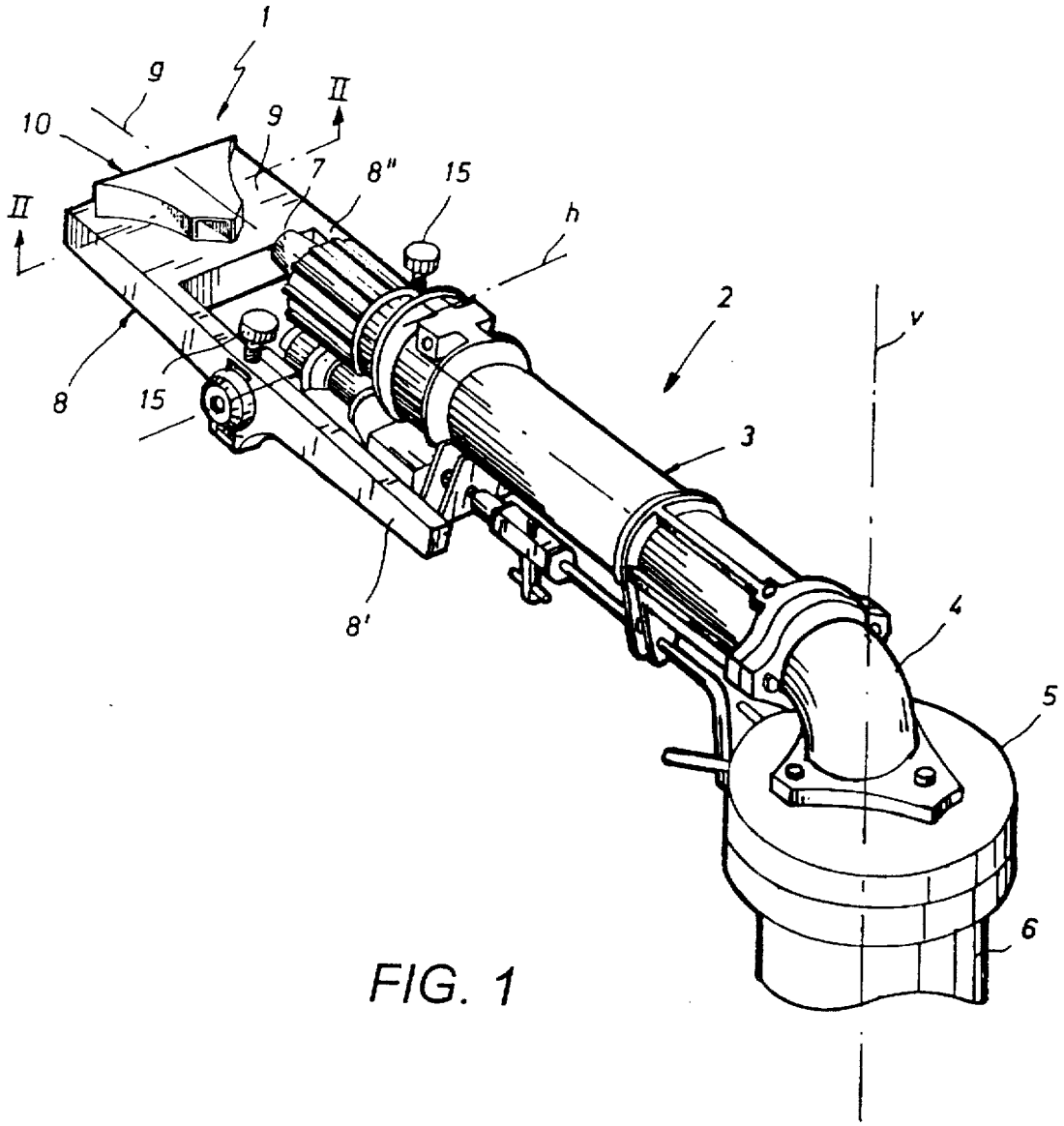
FIG. 1 is a general perspective view of a first embodiment of an actuator according to the invention, mounted on a pulse sprinkler.

With reference to the above figures, a jet actuator according to the invention, generally designated by the reference numeral 1, is applied to a rotating pulse sprinkler 2 of a conventional type.

The actuator could advantageously be used for the stepwise actuation of other hydraulic devices that have a pressurized water source, such as valves, gate valves, and signalling and control devices in the vicinity of water streams and basins.

Particularly, the rotating sprinkler of FIG. 1 comprises a spout 3 which forms a first longitudinal axis g that is tilted by a few degrees with respect to the horizontal and has, at one end, an elbow connector 4 which is in turn connected to a rotating coupling 5 that connects it to a pressurized water pipe 6.

The coupling 5 is essentially formed by two portions that are mutually coupled so as to form a seal and are free to rotate with respect to each other about a second substantially vertically axis v. The pipe 6 is anchored to a stationary support or to a trailer, not shown in the drawings, which rests on the ground.

A nozzle 7 is mounted at the free end of the spout 3 and is provided with a mouth of the desired diameter, so as to produce a continuous jet G that is directed along the axis g of the spout 3.

A supporting arm 8 is rotatably mounted on the spout 3 so that it can oscillate about a third axis h that is substantially horizontal and lies at right angles to the first axis g of the spout 3. Conveniently, the arm 8 can be formed by two lateral bars 8', 8" that are joined by a substantially flat end plate 9. The length of the arm is such that the flat end plate 9 protrudes beyond the nozzle 7 along the direction of the jet when the arm is substantially aligned with the spout 3. An elastic return means, not shown in the drawings and constituted for example by helical springs or by appropriate counterweights, is mounted on the pivoting axis h of the arm 8; this means tends to return the arm upward so that it is substantially aligned with respect to the spout 3.

A deflector 10 is fixed on the end plate 9 and forms the main part of the actuator 1. The position on the plate 9 is such that during the swinging motion of the arm 8 the deflector 10 oscillates transversely with respect to the axis g of the jet between a position that lies fully outside its path and a position in which it is immersed in the stream to the maximum extent. During immersion, the deflector 10 draws part of the kinetic energy of the jet to convert it into propulsive energy for the sprinkler.

According to the invention, the deflector 10 has a curved and convex main surface 11 that is suitable to dip laterally into the jet while remaining substantially aligned with the stream. By virtue of its curved and convex shape, the surface behaves substantially like a wing section immersed in a fluid stream and is accordingly subjected to a negative pressure force produced by fluid dynamics. The force that acts on the main surface 11 tends to return the deflector 10 towards the inside of the jet. This occurs both during startup of the sprinkler and during steady-state operation.

The main surface 11 is an approximately cylindrical surface with a preferably constant curvature radius and with an axis that lies substantially at right angles to the axis of the jet. Preferably, the radius of curvature of the main surface 11 is very large, for example between 200 and 800 mm. The behavior of the deflector has been found to be optimum with a radius of curvature of approximately 500 mm, using a water jet at a pressure of 2 to 10 bar and with mouth diameters between 10 and 50 mm.

If a right transverse sectional view of the cylindrical surface 11 is taken along a plane that lies at right angles to the axis of the surface, one obtains a profile that is shaped like a circular arc with a chord 1 that has a preset length, which can be advantageously comprised between 50 and 120 mm and is preferably close to 85 mm. The chord 1 also forms an average incidence angle $\alpha$ with the axis g of the jet.

According to the invention, the main surface 11 is arranged with respect to the jet so that when the jet barely skims the deflector, the surface is substantially tangent to the stream, with an angle of incidence $\alpha$ that is minimal and practically equal to zero.

Figure 3:
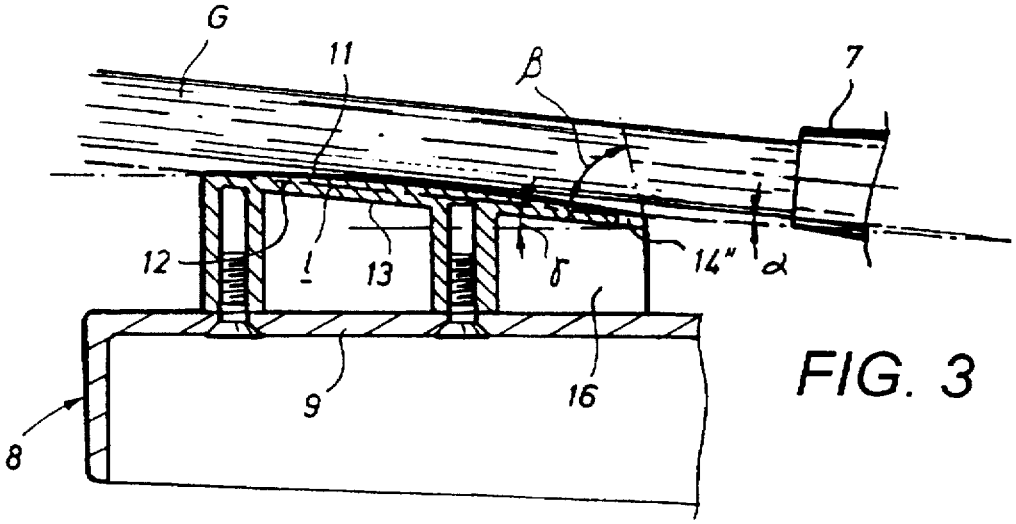
FIG. 3 is a sectional side view of the detail of FIG. 2, taken along a vertical plane III—III.
Figure 5:
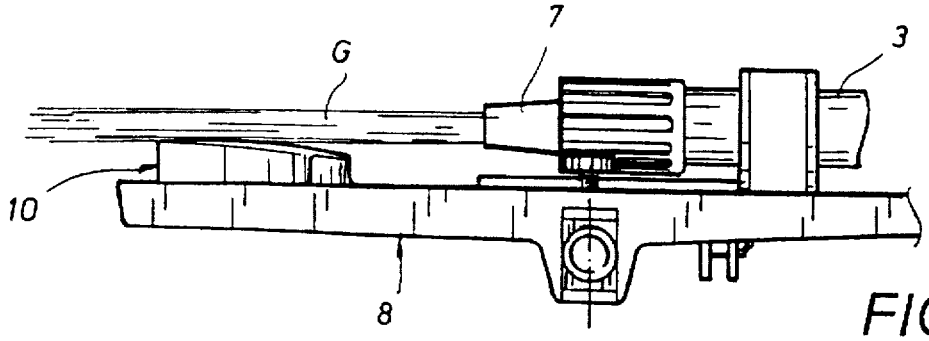
FIGS. 5 to 8 are side views of the actuator of FIG. 1 in different operating conditions.
Figure 6:
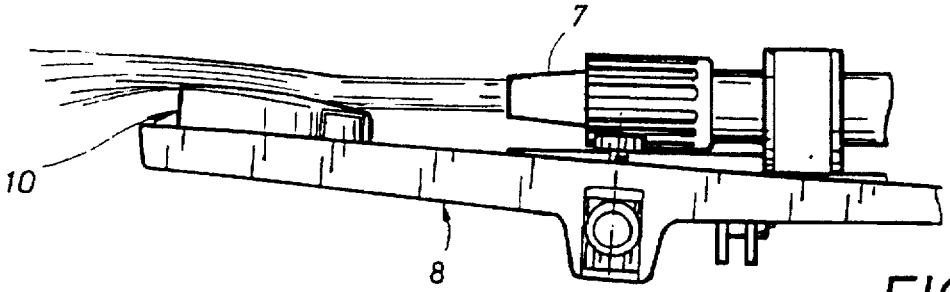

Furthermore, as the deflector is drawn towards the interior of the jet, i.e. upwards in FIGS. 3, 5, and 6, due to the negative pressure force generated by fluid dynamics the angle of incidence a of the surface 11 increases gradually but is always relatively small.

Figure 2:
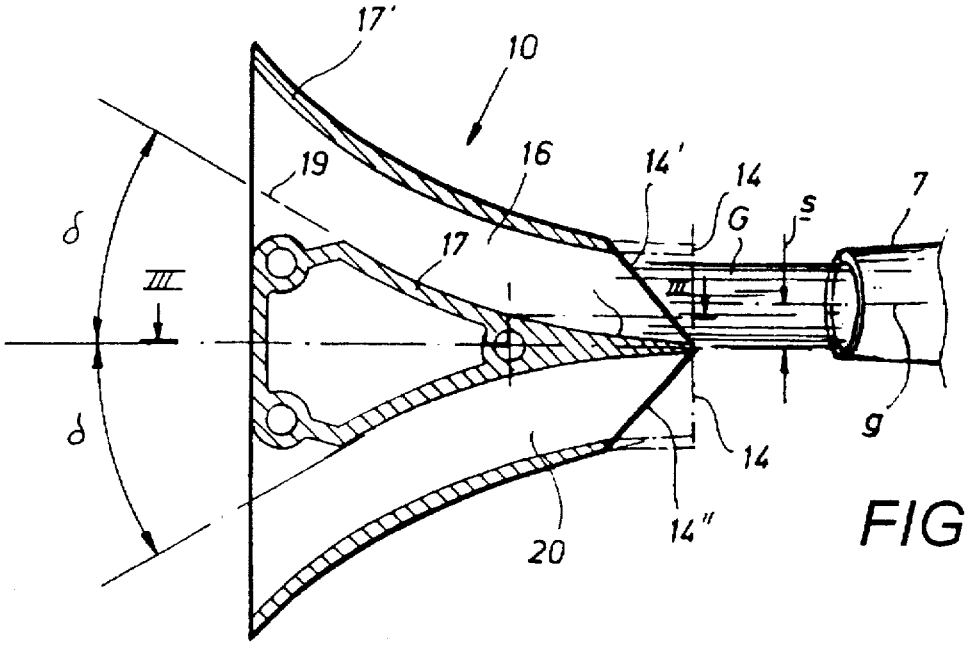
FIG. 2 is a sectional bottom view of a detail of FIG. 1, shown in enlarged scale, taken along the plane II—II.
Figure 4:
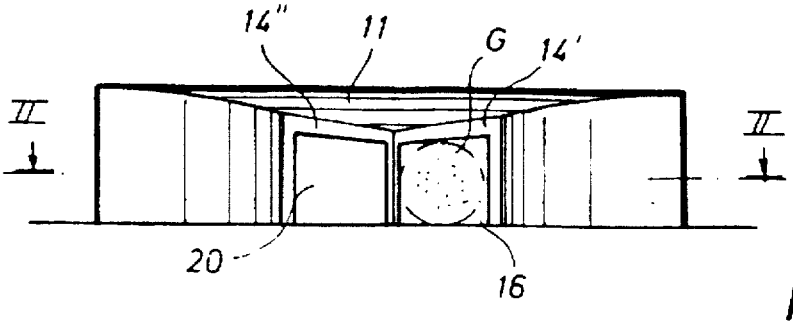
FIG. 4 is a front view of the detail of FIGS. 2 and 3.

With reference to FIGS. 2, 3, and 4, the deflector 10 comprises an actuator part 12 that has a relatively thin wall, for example with a maximum thickness of approximately 5 mm and with an approximately trapezoidal plan shape; the actuator part 12 is arranged so that its axis coincides with the centerline of the arm 8.

The upper face of the actuator part 12 is shaped like the main surface 11, whereas the lower face 13 is substantially flat and preferably lies parallel to the chord 1.

According to the invention, the deflector 10 has a secondary surface which is suitable to interact with the jet proximate to the maximum immersion position.

Particularly, the secondary surface is constituted by the transverse edge 14 that lies upstream of the actuator part 12, shown in broken lines in FIG. 2, which has a substantially flat shape and is steeply inclined with respect to the main surface 11. The solid angle β that lies between the two surfaces 11 and 14 is relatively large, for example between 60° and 85° and preferably close to 75°.

Figure 7:
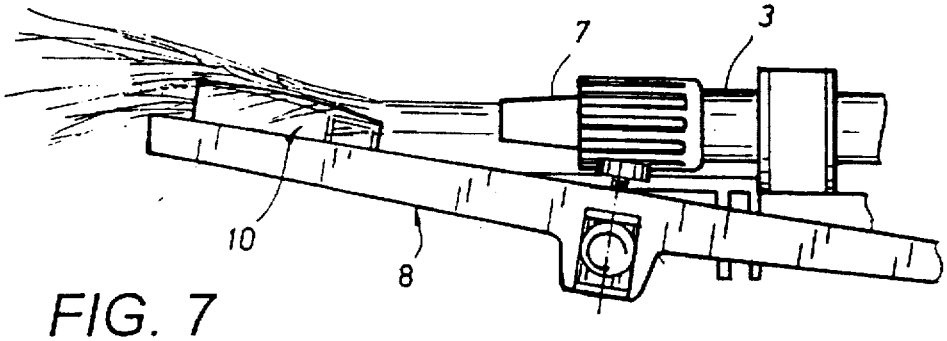

The presence of this secondary surface 14 produces a local and very sharp change in the direction of the fluid column, which however continues to adhere to the curved main surface 11 due to the boundary layer. As the angle of incidence α increases, the boundary layer becomes thinner and loses energy, until at a certain critical angle of incidence $\alpha_C$ it breaks up, creating a vortex downstream and allowing the separation of the fluid column from the curved main surface 11, as shown schematically in FIG. 7. It has been observed that for a deflector of the type shown in FIGS. 2, 3 and 4, the critical angle of incidence $\alpha_C$ lies between 6° and 16° and is preferably close to 12°.

This leads to a sudden drop in the negative pressure force produced by fluid dynamics, combined with a downward reaction force applied by the jet both on the secondary surface 14 and on the main surface 11.

Figure 8:
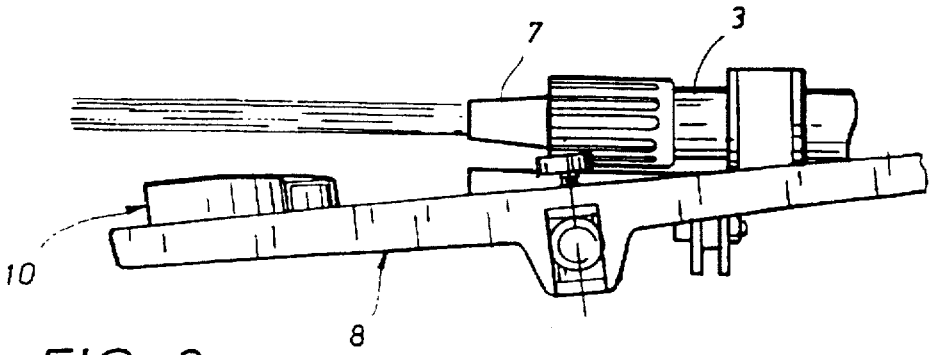
Figure 9:
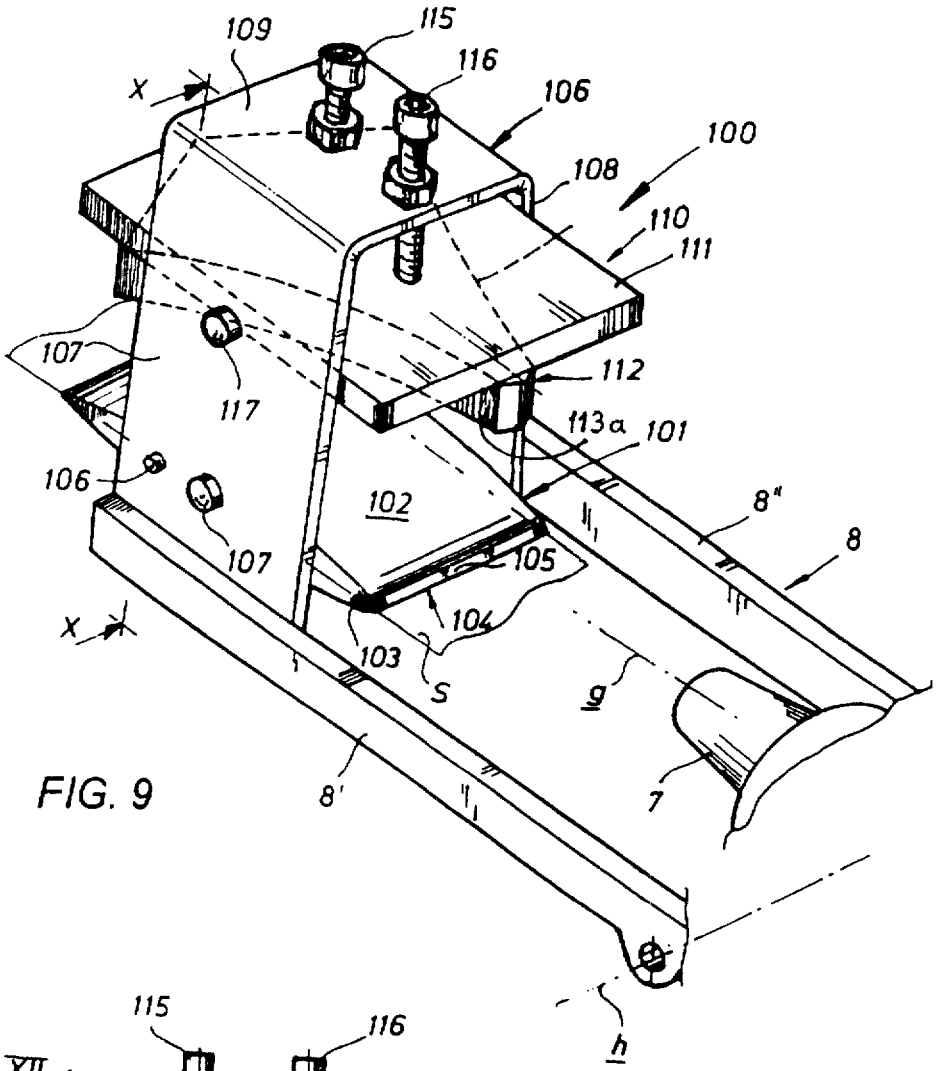
FIG. 9 is a general perspective view of a second embodiment of an actuator according to the invention, mounted on a rotating sprinkler.
Figure 10:
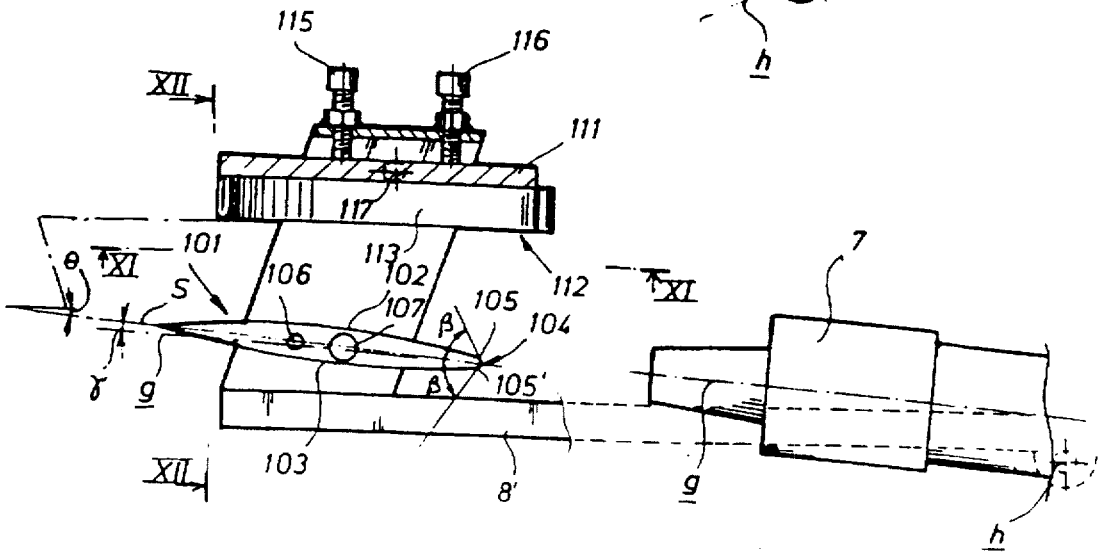
FIG. 10 is a sectional side view of the actuator of FIG. 9, taken along the plane X—X.
Figure 11:
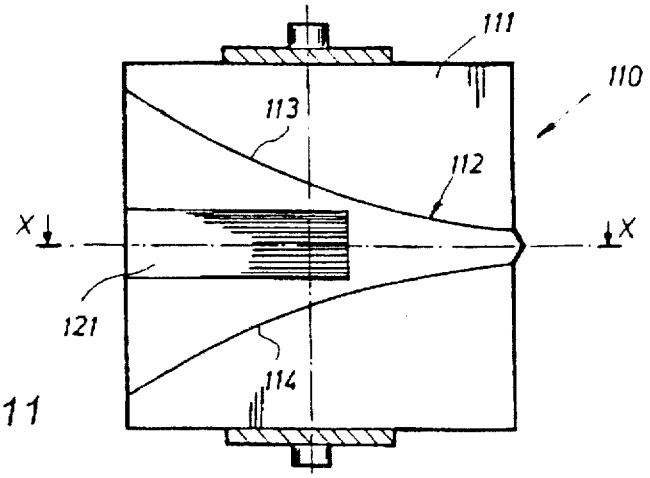
FIG. 11 is a sectional bottom view of a detail of the actuator of FIG. 10, taken along the plane XI—XI.

This produces the rapid expulsion of the deflector 10 from the jet, as shown in FIG. 8, triggering an oscillating motion of the arm 8 by virtue of the presence of the elastic return means or of optional counterweights. Once started, the oscillating motion continues in the steady state with a frequency, intensity and breadth that depend on the relative angles of the main surface 11 with respect to the jet, on the diameter of the jet, on its pressure, on the strength of the return forces, and on the moment of inertia of the system.

Optionally, in order to adjust the angle of incidence of the main surface 11 it is possible to provide screws 15 for adjusting the supports of the axis h of the arm.

In order to promote the rotation of the spout about its vertical axis v it is possible to provide a redirecting part which is meant to deflect the jet laterally and is suitable to produce a tangential reaction force in the arm 8.

This redirecting part comprises at least one curved channel 16 which is formed in the deflector 10. In particular, a channel 16 can be formed in the interspace between the end plate 9 of the arm and the lower face 13 of the laminar part 12, which is spaced and slightly inclined with respect to the plate 9 by an angle γ that measures between 0° and 10° and is preferably close to 5°. The channel is laterally delimited by a curved redirection wall 17 which lies substantially at right angles to the part 12. The presence of a second side wall 17' that is substantially parallel to the first one 17 is optional, since it is not normally affected by the jet.

Conveniently, the initial portion 18 of the wall 17 is substantially parallel to the longitudinal direction of the arm and is thus aligned with the axis g of the jet, whereas the final portion 19 is reorientated laterally with respect to the inlet portion.

Advantageously, the lateral redirection angle measures between 20° and 50° and is preferably close to 35°. The redirection applied to the jet after passing through the channel 16 applies a tangential torque to the arm, and this torque is transferred to the spout 3 through the oscillation axis h.

Obviously, with a single redirection channel it is possible to impart a rotation to the spout 3, and thus to the entire irrigation device, in a single direction about the axis v.

In the illustrated embodiment there are two adjacent redirection channels 16 and 20 which are substantially symmetrical with respect to the centerline of the arm. By aligning one channel at a time with respect to the jet, by virtue of a corresponding axial displacement s of the arm, it is possible to reverse the rotation direction of the sprinkler.

In order to facilitate the entry of the jet in the channels 16 and 20, the respective leading edges 14' and 14" have a V-shaped arrangement with an internal angle that measures between 60° and 180° and is preferably close to 100°.

In the second embodiment of the actuator according to the invention, shown in FIGS. 9 to 14, the parts that are in common with the first embodiment are designated by the same reference numerals used in FIGS. 1 to 8.

A deflector 100 is mounted on the arm 8 and comprises an actuation part 101 that is shaped like a wing section with curved surfaces 102 and 103 and a substantially straight leading edge 104. The curved upper surface 102 corresponds to the main surface 11 and the lower surface 103 corresponds to the lower face 13 of the part 12 shown in FIGS. 1 to 4. The surfaces 102 and 103 are arranged symmetrically with respect to a plane referenced by S in FIG. 10 which is substantially parallel to the pivoting axis h of the oscillating arm 8 and forms an angle of incidence γ with respect to the axis g of the jet G in order to avoid instability of the actuator during startup and give the arm 8 an initial upward or downward thrust.

The part 101 is arranged so that when the arm 8 is in the idle or initial condition, the jet skims tangentially over the surface 102 or 103 and forms a relatively small angle α with respect to the plane of symmetry S. For small actuators, for example with jets that have a diameter between 1.5 and 3 cm, the edge 104 of the part 101 can be sharp. Preferably, for larger actuators the leading edge 104 of the part 101 is formed by two secondary surfaces 105, 105' which are formed respectively on the surfaces 102 and 103 and are inclined at a relatively large angle β with respect to the plane of symmetry S. In this way, at a given critical angle of incidence $\alpha_C$ of the jet the boundary layer breaks up and the negative pressure force produced by fluid dynamics that acts on the face 102 drops sharply, causing a sudden reversal of the forces produced by fluid dynamics that act on the part 101. In practice, the part 101 is drawn upward, that is to say, towards the axis of the jet, due to the negative pressure on the surface 102, until it reaches the tilt $\alpha_C$ of its plane of symmetry S, and is then pushed down due to the thrust on the surface 102. In this way, oscillation begins in any operating condition with a gradually increasing breadth.

The actuator part 101 is fixed to a substantially U-shaped bracket 106, particularly toward the end of its parallel sides 107 and 108 which are mutually connected by a transverse wall 109. The bracket 106 is in turn rigidly anchored to the side bars 8', 8" of the oscillating arm 8.

A redirecting part 110 is fixed between the sides 107 and 108 of the bracket 106, proximate to the transverse wall 109. This part comprises an anchoring plate 111 which is substantially flat and rectangular and to which a redirecting plate 112 is fixed; the plate 112 is thicker and narrower than the upper one, and has curved lateral walls 113 and 114 which are approximately symmetrical with respect to a plane T that is substantially parallel to the longitudinal axis g of the spout 3 and lies at right angles to the plane of symmetry S. The plate 111 is tilted and convergent along the direction of the stream with respect to the plane of symmetry S of the part 101, so as to form an angle θ with respect to the part 101. In order to vary this angle, it is possible to provide two adjustment screws 115 and 116 arranged along the longitudinal plane T so as to rotate the plate 111 about the pivoting axis formed by the screws 117 and 118.

Conveniently, the redirecting walls 113 and 114 form, together with the upper plate 111, two lateral channels which are suitable to redirect the jet laterally with respect to the longitudinal axis g of the nozzle 7, promoting the stepwise rotation of the spout 3. By varying the tilt of the arm 8 with respect to the spout 3, one redirecting channel at a time is exposed, causing the rotation of the spout 3 about the second axis v in one direction or the other.

The lower face 120 of the plate 112, which is struck by the jet when the deflector 110 moves downward during oscillation so as to give the deflector 100 an upward thrust, can be flat, with a central recess 121 which is inclined by an angle $\epsilon$ with respect to the angle of the plate 111, so as to reduce the interference of the jet during the downward motion of the deflector. In this way, the amount of energy drawn from the jet for lateral redirection is substantially unchanged as the diameter and pressure of the jet increase.

Figure 12:
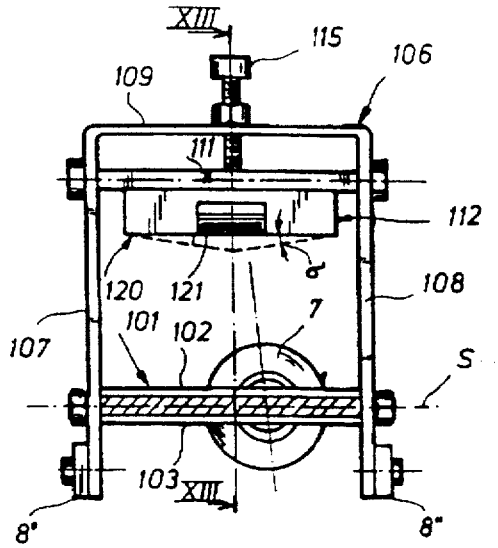
FIG. 12 is a sectional front view of the actuator of FIG. 10, taken along the plane XII—XII.
Figure 13:
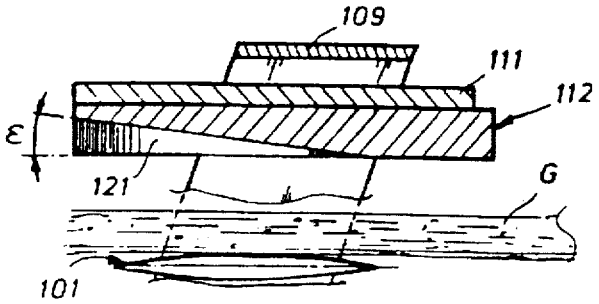
FIGS. 13 and 14 are schematic sectional views of the actuator of FIG. 9 in two different operating positions.
Figure 14:
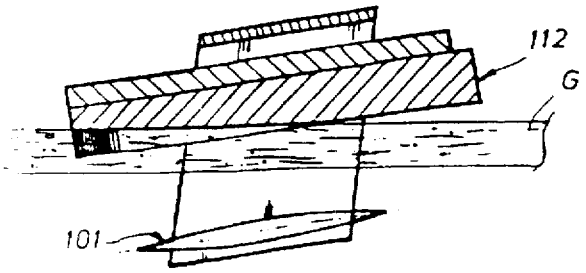

As an alternative, the lower face of the plate 112 can be shaped with two symmetrical surfaces which are inclined at an angle $\delta$ which is equal to approximately 15°, as shown by the dashed line in FIG. 12, eliminating the central recess 121.

In summary, in this embodiment, too, the actuator part 101 of the deflector 100 is meant to trigger and maintain in a steady state the oscillating motion of the arm 8 about its axis h, whereas the redirecting part 110 is meant to apply a stepwise rotary motion to the spout with respect to the second substantially vertical rotation axis v, so as to cover a circular region to be sprinkled.

The jet actuator according to the invention is particularly effective and reliable even with small-diameter jets and at relatively low pressures, and can also be applied to small sprinklers.

The actuator according to the invention is susceptible to numerous modifications and variations.

All the details may be replaced with technical equivalents that are understood to be equally protected. The materials, the shapes and the dimensions may be any according to the requirements.

I claim:

1. A jet actuator, particularly for actuating hydraulic apparatus such as rotating pulse sprinklers, which comprises:

a nozzle for generating a free jet of water directed along a first longitudinal axis, said nozzle being located at the free end of a spout, said spout being coupled to a line of pressurized water by means of a rotatable joint having a second rotation axis that is transverse to said first longitudinal axis;

a deflector which can freely oscillate in a transverse direction between a first end position wherein the deflector lies completely outside the jet and a second end position wherein the deflector is immersed to the maximum extent in the jet so as to draw part of its energy; and a support means for oscillably mounting said deflector on said spout to transfer the energy drawn from the jet to said spout to promote a stepwise movement thereof about said second rotation axis;

wherein said deflector has at least one main surface having a curved and convex shape suitable to laterally enter the jet while remaining, substantially aligned with the jet, so as to generate a negative pressure force tending to move said deflector towards the interior of the jet upon initial oscillation and during steady-state oscillatory operation, and a secondary surface that is substantially flat and forms with respect to the curved main surface a solid angle that is relatively large so as to generate a reaction force with a component which is opposite to the negative pressure force produced on said curved main surface and tending to expel said deflector away from the jet thus starting and maintaining the steady-state operation.

2. A jet actuator according to claim 1, wherein sad curved main surface is approximately cylindrical with a relatively wide and constant radius of curvature and with an axis that lies substantially at right angles to the axis of the jet.

3. A jet actuator according to claim 2, wherein a right transverse cross-section of said curved main surface has a profile that is substantially shaped like a circular arc in which a chord and a reference plane form an average incidence angle with respect to said first longitudinal axis.

4. A jet actuator according to claim 3, wherein said curved main surface is so profiled to be substantially tangent to the jet when said deflector barely skims the jet.

5. A jet actuator according to claim 3, wherein said chord and said reference plane of said curved main surface are so oriented to form, during immersion in the jet, an angle of incidence with respect to the axis of the jet that gradually increases as said deflector is drawn towards the interior of the jet.

6. A jet actuator according to claim 5, wherein said angle of incidence has a critical value adapted to cause separation and complete breakup of the fluid column upstream of said main surface and a sudden drop in the negative pressure force exerted thereon with a sharp reversal of a resultant force acting on said deflector.

7. A jet actuator according to claim 6, wherein said critical angle of incidence is between 6° and 16°.

8. A jet actuator according to claim 1, wherein said solid angle is between 60° and 85°.

9. A jet actuator according to claim 1, wherein said second rotation axis is substantially vertical.

10. A jet actuator according to claim 1, wherein said support means comprises a substantially rigid arm pivotably mounted on said spout for oscillation about a third oscillation axis that is substantially horizontal.

11. A jet actuator according to claim 10, wherein said deflector comprises an actuator part with a relatively thin wall that has an upper face formed with said curved main surface, a lower face, and a transverse leading edge forming said secondary surface.

12. A jet actuator according to claim 11, wherein said actuator part is anchored to a substantially flat end plate which is rigidly coupled to said arm, said lower face being slightly spaced and inclined with respect to said end plate of the arm by an angle that measures between 0° and 10°.

13. A jet actuator according to claim 11, wherein said deflector has a redirection part means that is suitable to cause the lateral deflection of the jet, with a consequent tangential reaction force, in order to promote the rotation of the spout about said second rotation axis.

14. A jet actuator according to claim 13, wherein said redirection part means comprises at least one curved channel which lies between said end plate of the arm, said actuator part, and at least one curved redirection wall that is substantially perpendicular to said actuator part, said redirection wall having an initial portion which is substantially parallel to the longitudinal direction of the arm and a final portion that is reoriented substantially laterally with respect to the initial portion.

15. A jet actuator according to claim 16, wherein said redirection part means comprises two redirection channels which are adjacent and substantially symmetrical with respect to a centerline of said arm.

16. A jet actuator according to claim 15, wherein said redirection part means includes a laminar part with a leading edge, the leading edge of said laminar part at said two redirection an internal angle that measure between 60° and 180°.

17. A jet actuator according to claim 11, wherein said actuator part is substantially shaped like a wing section with upper and lower surfaces that are substantially symmetrical with respect to a plane of symmetry that corresponds to said reference plane said wing section being provided with said leading edge that forms said secondary surface.

18. A jet actuator according to claim 17, wherein said redirection part means comprises a substantially flat anchoring plate under which a redirecting plate is fixed, said redirecting plate having at least one curved lateral redirecting surface which forms at least one redirecting channel with said anchoring plate.

19. A jet actuator according to claim 18, wherein said actuator part and said redirection part means are held in position between the lateral arms of a substantially U-shaped bracket which is in turn anchored to the end of said arm.

20. A jet actuator according to claim 14, wherein a lateral redirection angle of said curved lateral redirecting surface measures between 20° and 50°.

21. A jet actuator according to claim 6, further comprising means for adjusting the position and the angles of incidence of said main surface and of said secondary surface with respect to the axis of the jet in said critical incidence position.

22. A jet actuator according to claim 11 wherein said lower face is substantially flat.

23. A jet actuator according to claim 11 wherein said lower face is curved.

* * * * *